United States Patent [19]

Niemela et al.

[11] 4,123,957

[45] Nov. 7, 1978

[54] CHAIN SAW AND WORK PIECE SUPPORT APPARATUS

[75] Inventors: W. Wally Niemela, Box 165E, Chassell, Mich. 49916; Earl J. Lampinen, Hancock, Mich.

[73] Assignee: W. Wally Niemela, by said Earl J. Lampinen, Chassell, Mich.

[21] Appl. No.: 770,649

[22] Filed: Feb. 22, 1977

[51] Int. Cl.[2] ..... B27B 17/02

[52] U.S. Cl. ..... 83/796; 83/798; 83/574; 83/564

[58] Field of Search ..... 83/574, 564, 796, 798, 83/794, 795, 799, 811, 486.1, 490, 747

[56] References Cited

U.S. PATENT DOCUMENTS

| | | | |
|---|---|---|---|
| 1,952,270 | 3/1934 | March et al. | 83/798 |
| 3,139,124 | 6/1964 | Hoff | 83/486.1 |
| 3,429,347 | 2/1969 | Klein | 83/435.1 |
| 3,433,277 | 3/1969 | Ribley | 83/796 |

*Primary Examiner*—Donald R. Schran

*Attorney, Agent, or Firm*—Price, Heneveld, Huizenga & Cooper

[57] ABSTRACT

Support apparatus for supporting logs, boards and other work pieces to be cut either transversely or lengthwise, as well as for supporting a chain saw by its blade for performing the cutting. A support platform includes a top surface, preferably inclined downwardly toward an operator position, and a restraining rail to hold the work pieces in position for cutting. A spring-biased, rotatable axle mounts the chain saw by the free end of its blade for pivotal movement along one side of the platform to transversely cut work pieces. Alternately, a rigid saw support holds a chain saw vertically upright with its blade plane parallel to the direction of elongation of the work pieces for rip cutting. An outwardly extending, side support, opposite the saw support, movably mounts a second platform for additional support and movement of long logs, boards or other work pieces.

19 Claims, 9 Drawing Figures

CHAIN SAW AND WORK PIECE SUPPORT APPARATUS

BACKGROUND OF THE INVENTION

This invention relates to supports for logs, boards and other work pieces during cutting and, more particularly, to a support structure adapted to support elongated logs, wooden boards and other work pieces for transverse or longitudinal or rip sawing as well as for supporting a chain saw for performing the sawing operations.

Numerous devices have been devised in the past to support various types of work pieces during cutting as well as for mounting saws to cut those work pieces when supported. Many of the prior devices have included band saws, circular saws or the like which are pivotally mounted on support arms for downward pivotal movement through the work piece to be cut. Typically, such structures have been relatively complex and required an extensive support framework for mounting the saw, especially those of the band saw type. In the case of circular saws, the support arms often were attached directly to the saw casing and were wellsuited for cutting boards but could not adequately handle logs and other random or bulky sized work pieces such as logs of large diameter.

Other prior structures included apparatus for mounting chain saws with respect to a framework for cutting logs or the like. Again, the prior structures tended to be quite complex and, therefore, difficult and expensive to manufacture, or were comparatively difficult to attach the saw to. Many of the structures required attachment of the chain saw by means of the engine casing at the engine end of the saw. This required a relatively awkward pivotal movement of the saw about such an attachment point. Leverage on the saw pivoted about its engine casing was difficult to obtain. An example of this type structure is shown in U.S. Pat. No. 3,154,120, issued Oct. 27, 1964, to R. H. Lesher, entitled "ATTACHMENT FOR PORTABLE CHAIN SAWS", wherein the saw is supported directly on the work piece and does not provide separate structure for supporting the work pieces.

Other structures disclose apparatus for supporting chain saws by their blades but necessitated involved support arms leading to the engine end of the saw to provide adequate support. An example of this type structure is shown in Swiss Pat. No. 374,192.

An additional problem with many of the prior structures was the adequate support of lengthy logs, boards or other work pieces and the movement of the logs to the cutting area after a portion of the logs had been cut. Also, the prior structures did not provide apparatus for securing the saws, and especially chain saws, in alternate positions so that elongated work pieces could be cut or ripped lengthwise.

The present invention was devised to provide a simple, reliable structure for both supporting work pieces to be cut as well as supporting a chain saw for cutting the work pieces either transversely or lengthwise without the necessity of complex supporting structure for the saw.

SUMMARY OF THE INVENTION

Accordingly, the present invention provides a support apparatus for supporting logs, boards and other work pieces, and especially elongated work pieces, as well as for supporting a chain saw only by means of its blade for cutting work pieces either transversely or lengthwise as desired. A platform is provided and supported above the ground or a supporting surface by a plurality of support legs. The platform includes a top, work piece supporting surface having side edges as well as restraining means for holding work pieces on the top surface in position to be cut.

In one aspect, the invention includes rotational axle means mounted on the platform top surface and extending beyond one side edge of the top surface for supporting a chain saw only by its blade for pivotal movement about a point adjacent the free end of the blade in a plane parallel to that one side edge to cut a work piece in a direction transverse to its direction of elongation. Biasing means are provided to return the rotational axle means, and any chain saw supported thereon, to an upright positon in preparation for the next cutting operation.

In another aspect, the invention includes a rigid support structure for supporting a chain saw by its blade in a generally vertically upright position which is generally perpendicular to one side edge of the top surface to cut or rip logs, boards and other elongated work pieces parallel to their directions of elongation.

In yet another aspect of the invention, additional work piece support means are included extending from the side of the platform opposite the side at which the chain saw is mounted for supporting a work piece portion not supported by the platform which supports the chain saw. The additional work piece support means include a second platform and an elongated support for the second platform extending to that opposite side. The second platform is mounted for movement toward and away from the first platform so that logs or other work pieces may be easily moved into position for additional cutting while being properly supported at positions spaced along their lengths.

The present invention provides numerous advantages over prior known structures because it allows the cutting of work pieces both transversely and longitudinally by making a simple change in position of the chain saw. In addition, the supporting structure for the chain saw is of minimal size and yet very durable. The pivotal support structure for cutting work pieces transversely is positioned to enable proper leverage on the saw to cut through the work pieces. Further, the apparatus is susceptible of use by a single person even when lengthy logs or other work pieces are being cut because of the provision of the additional support structure at the side opposite the saw support. This enables a single person to perform the cutting operations and easily and quickly move the work piece into position for another cut.

These and other objects, advantages, purposes and features of the invention will become more apparent from a study of the following description taken in conjunction with the drawings.

DESCRIPTION OF THE PREFERRED EMBODIMENT

Figure 1:
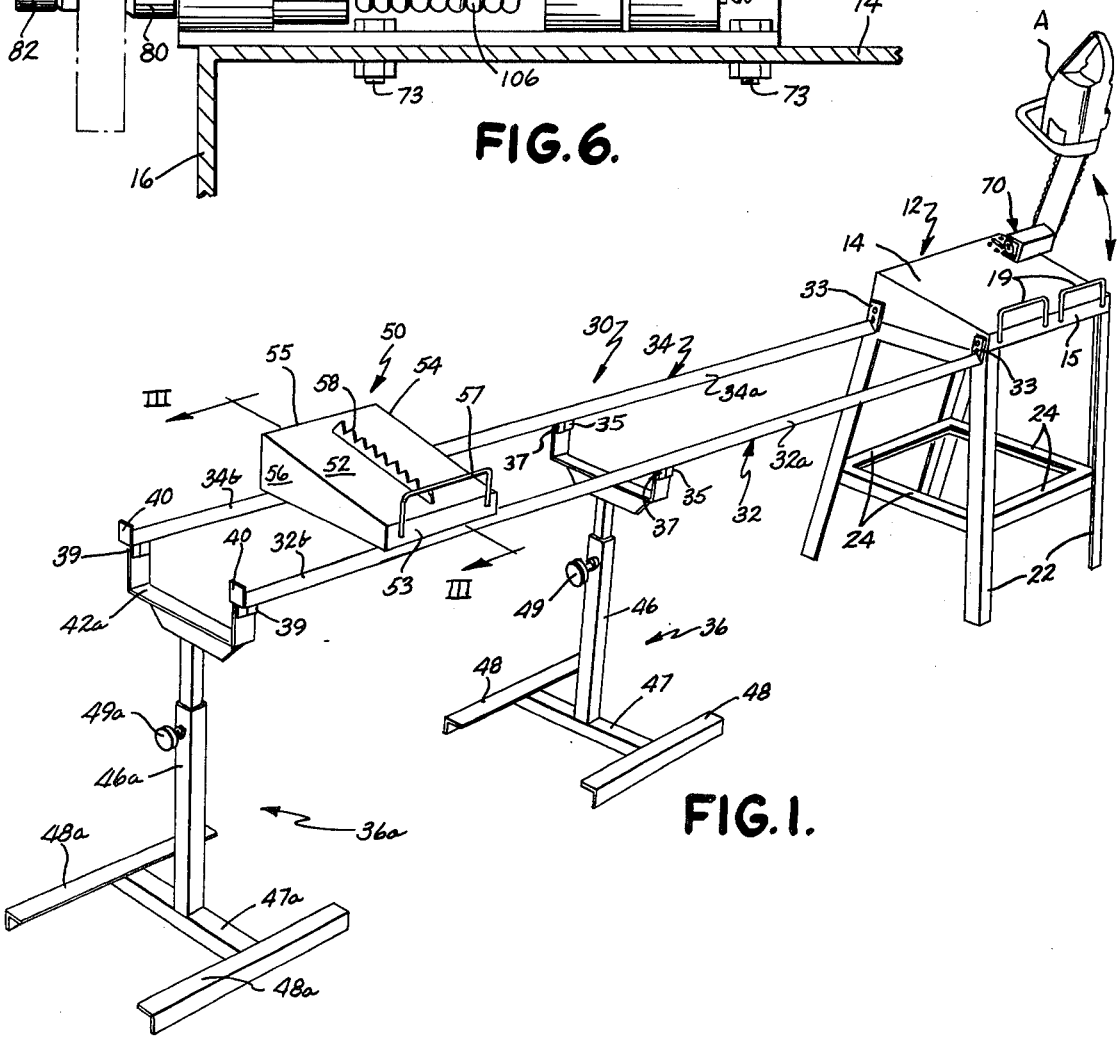
FIG. 1 is a perspective view of the support apparatus of the present invention with a typical chain saw rotatably mounted on the apparatus for transverse cutting of logs and other work pieces.
Figure 2:
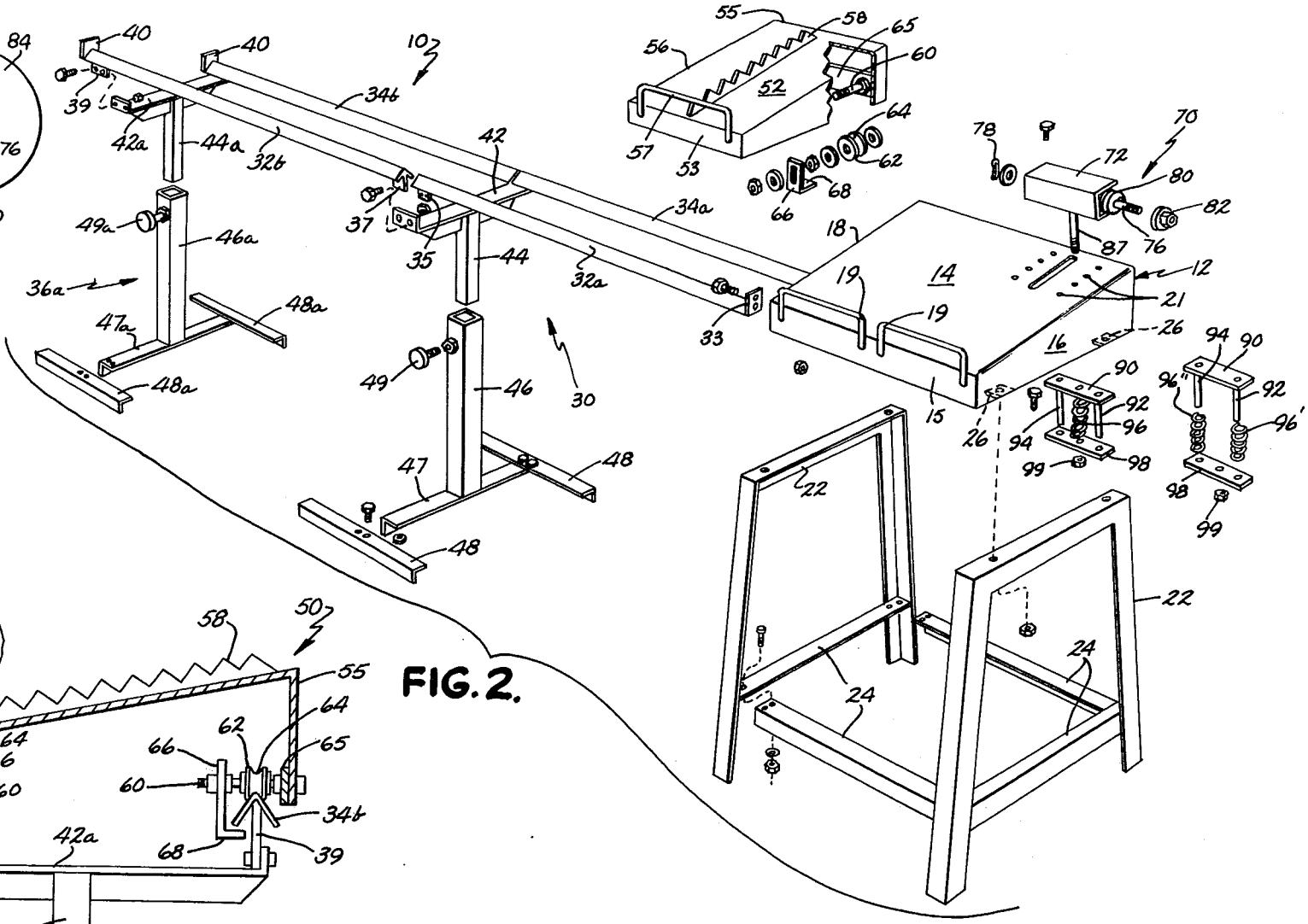
FIG. 2 is an exploded, perspective view of the support apparatus of the present invention.
Figure 7:
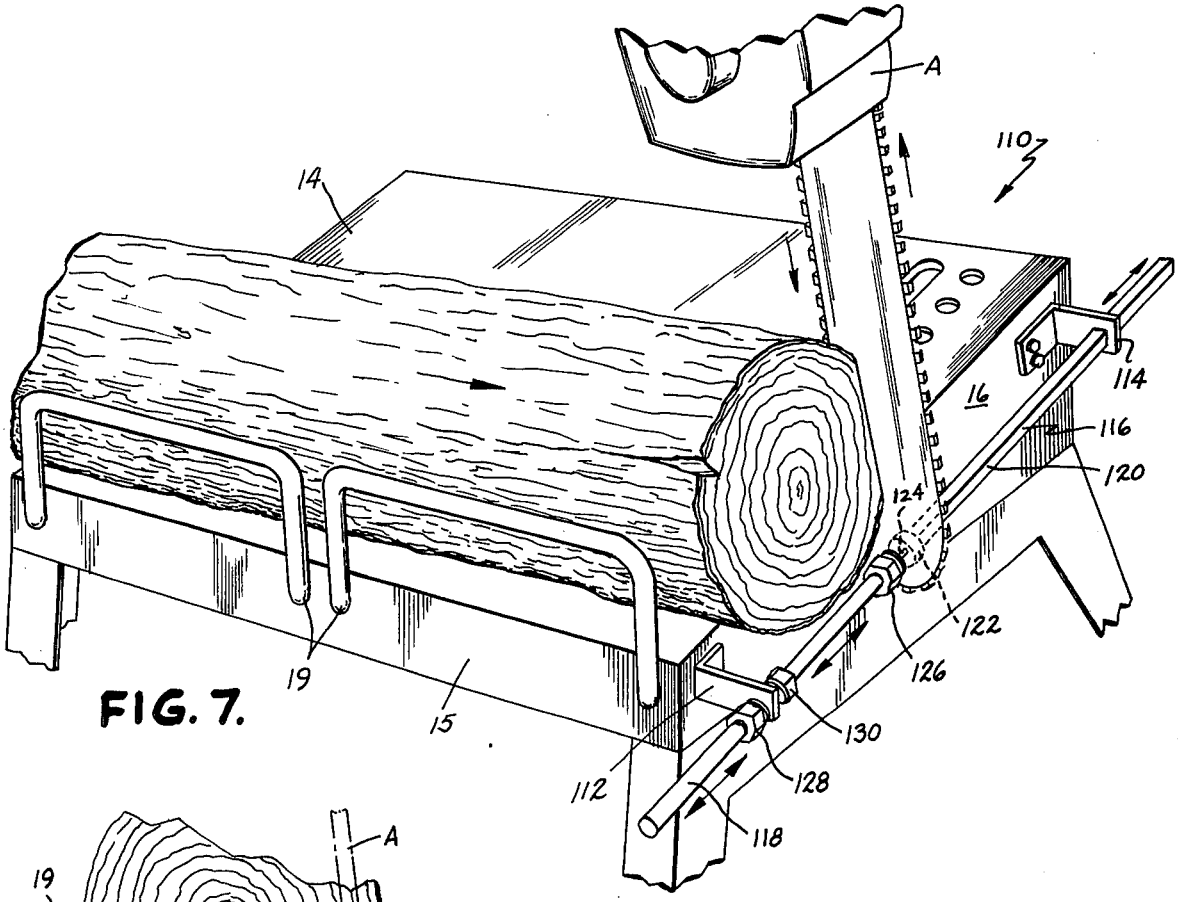
FIG. 7 is a fragmentary, perspective view of another embodiment of the support apparatus of the present invention illustrating the rigid saw support for holding a chain saw in a generally vertically upright position for rip or longitudinal cutting of logs and other work pieces.
Figure 8:
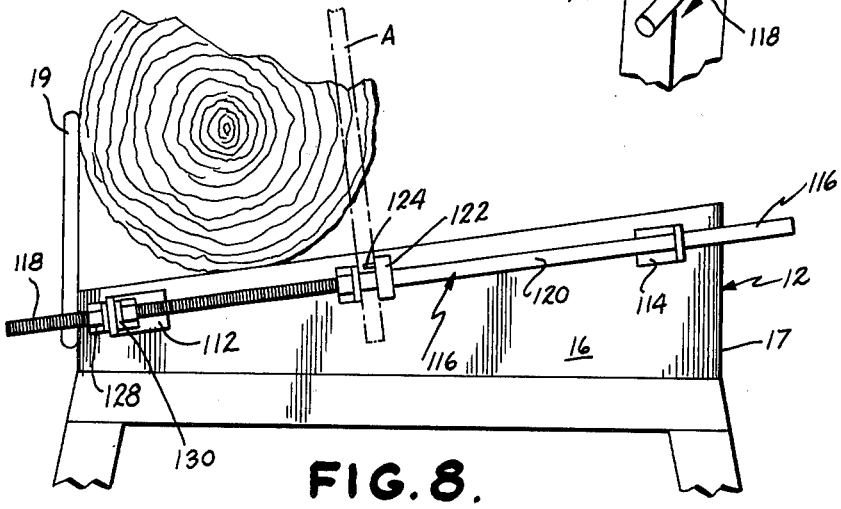
FIG. 8 is a fragmentary, side elevation of the support apparatus shown in FIG. 7.
Figure 9:
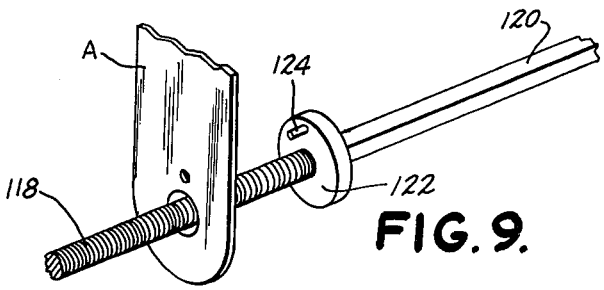
FIG. 9 is a fragmentary, perspective view of the attachment of a chain saw blade to the rigid support structure of FIGS. 7 and 8.

Referring now to the drawings in greater detail, FIGS. 1 and 2 illustrate the support table and chain saw support apparatus 10 of the present invention including a stationary table or platform 12 and an elongated, additional support assembly 30 on which is mounted a movable carriage platform 50 for supporting the ends of logs or other elongated work pieces not supported by the stationary platform 12. A pivot or rotatable axle assembly 70 or 100 is mounted atop the stationary table 12 for securing a chain saw only by its blade to the table. In addition, as shown in FIGS. 7–9, a rigid chain saw support 110 for rip sawing operations is secured to the side of the table 12 opposite the elongated support 30 and movable carriage 50 as an alternative support for the chain saw.

Figure 3:
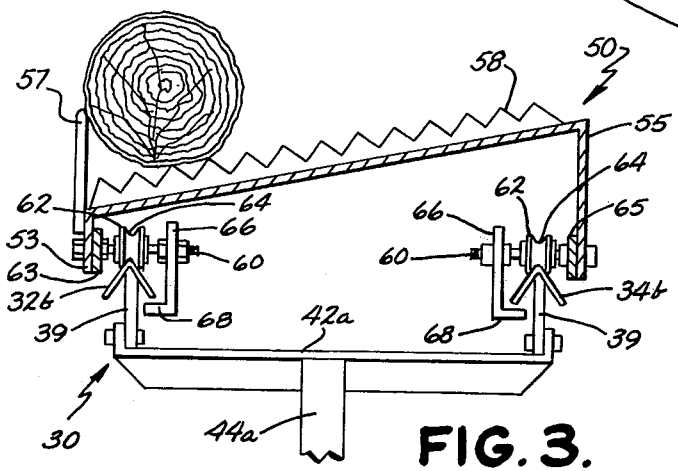
FIG. 3 is a fragmentary, sectional view of the movable carrier platform and support rails along plane III—III of FIG. 1.

Chain saw A is supported at the free end of its blade by pivot assembly 70, or alternative pivot assembly 100, for transverse cutting of logs having one end supported on table 12 and the other end supported on movable carriage platform 50 (FIG. 3). Alternatively, for rip or lengthwise cutting of logs or other work pieces, the chain saw A is rigidly mounted with the blade parallel to the log or work piece or perpendicular to the side of table 12, as shown in FIGS. 7–10, to allow longitudinal cutting as the log is pushed through the chain saw blade by moving carriage 50 toward table 12.

As shown in FIGS. 1 and 2, stationary table or platform 12 includes a top surface 14 and downwardly extending, integral sides 15, 16, 17 and 18 formed with or welded to top 14 at the edges thereof. Top surface 14 is preferably inclined downwardly toward the front of the apparatus and an operator position at the lower edge of the top surface. Generally, U-shaped restraining rods or rails 19 are welded to side 15 at the lower edge of top surface 14 and project upwardly beyond the top surface for holding a log, board or other work piece in position adjacent the operator position as urged by gravity due to the downward incline of top surface 14 (see FIG. 3). As viewed from the operator position, the upper right-hand corner of top surface 14 includes an elongated slot 20 extending parallel to side 16 of the platform and a plurality of bolt holes 21 on either side of the slot. Slot 20 and holes 21 provide a mounting area for the rotatable or pivot axle assembly 70 secured to top surface 14.

Table or platform 12 is supported on a pair of generally U-shaped leg assemblies 22 each including a pair of downwardly and outwardly diverging legs interconnected by horizontal stringers or braces 24 as shown in FIGS. 1 and 2. Attachment of platform 12 to the legs 22 is made with inwardly extending securing tabs 26 on the inside surfaces of sides 16 and 18 (FIG. 2) through which bolts are passed into the leg assembly.

As is also seen in FIGS. 1 and 2, an elongated, horizontal support assembly 30 extends outwardly from side 18 which is the side opposite to side 16 on which chain saw A is mounted on pivot assembly 70. Along with movable carriage 50, assembly 30 provides a support for a portion of a work piece spaced from the portion supported by table 12 while being cut with a saw also supported by table 12. Support assembly 30 includes a pair of identical, parallel support rails 32, 34. Each rail includes a pair of rail sections, rail sections 32*a* and 34*a* being bolted to side 18 by means of tabs 33 and to a rail support 36 by means of tabs 35. Rail sections 32*b* and 34*b* extend outwardly and coaxial, parallel to, and flush with rail sections 32*a* and 34*a*, respectively. Rail sections 32*b*, 34*b* are bolted to rail support 36 at one end by tabs 37 and to a second rail support 36*a* by tabs 39. Each rail section 32*b*, 34*b* includes a foot or stop 40 at its terminal end to prevent carriage platform 50 from rolling off the end. As is best seen in FIGS. 2 and 3, each of the rail sections 32*a*, 34*a*, 32*b*, 34*b* has a cross-sectional shape of an inverted, upwardly extending "V" such that the rollers for carriage platform 50 are supported at the apex of the "V".

Rail support units 36, 36*a* are identical. Like parts are identified by the same numbers with the addition of "a" for support 36*a*. The support units include generally U-shaped, horizontal cross braces 42, 42*a*, each including upwardly extending legs at its ends to which the rail tabs 35, 37 and 39 are bolted (FIGS. 1–3). Extending vertically downwardly and rigidly secured to the cross braces are vertical, tubular shafts 44, 44*a* telescoped within larger, hollow, vertical support tubes 46, 46*a* having lower cross feet 47, 47*a*. Elongated feet 48, 48*a* are welded or otherwise fixedly secured to the ends of cross feet 47, 47*a* to laterally support the units. Vertical shafts 44, 44*a* may be vertically adjusted within vertical tubes 46, 46*a* and held in position by set screws 49, 49*a* so that rails 32, 34 may be adjusted to be substantially horizontal and parallel to top surface 14. Top surface 52 of movable carriage 50 will thus be parallel and flush with top surface 14 of stationary table 12 even when the apparatus 10 is used on uneven ground.

As shown in FIGS. 1–3, movable carriage 50 includes an inclined planar top surface 52 which is parallel to and flush with top surface 14 when rails 32, 34 are adjusted by means of support assemblies 36, 36*a* to be in the proper horizontal plane. Carriage 50 is similar to stationary table 12 and includes downwardly extending, integral sides 53, 54, 55 and 56 extending from the side edges of top 52. A work piece restraining rail 57 extends upwardly above surface 52 from side 53 while a saw-tooth log or other work piece gripping member 58 is welded centrally on surface 52 parallel to sides 54, 56. Gripping member 58 projects into and grips the logs or other work pieces as is shown in FIG. 3 so that movement of carriage 50 along rails 32, 34 will cause corresponding lengthwise movement of the work piece toward and away from the saw A secured to table 12.

Movement of carriage platform 50 is accomplished by four rollers secured at each of the four corners of the platform 50 on the inside surfaces of walls 53, 55. Each of the roller assemblies is identical and includes an inwardly extending axle or bolt 60 on which is rotatably mounted a roller 62 having a V-shaped recess 64 matching the shape and contour of the "V" shape of rails 32, 34. Plates 63, 65, running the entire width of the movable platform, reinforce sides 53, 55 for support of the axles. At the inward end of each of the axles 60 is fixedly mounted a generally L-shaped hold-down bracket 66 extending downwardly from the axle with an outwardly extending foot or leg 68 protruding under the inner edge of the rail on which its roller 62 is mounted. Feet 68 prevent carriage platform 50 from being lifted off the rails unexpectedly by an unbalanced load of logs or work pieces. In addition, the lateral, diverging sides of the V-shaped grooves 64 in each of the rollers 62 serve to guide the lengthwise movement of the carriage 50 along rails 32, 34 and prevent the carriage from being shifted transverse to the longitudinal direction of the rails, i.e., laterally off the rails. The vertical extending portions of L-shaped brackets 66 also help to prevent lateral shifting.

Figure 4:
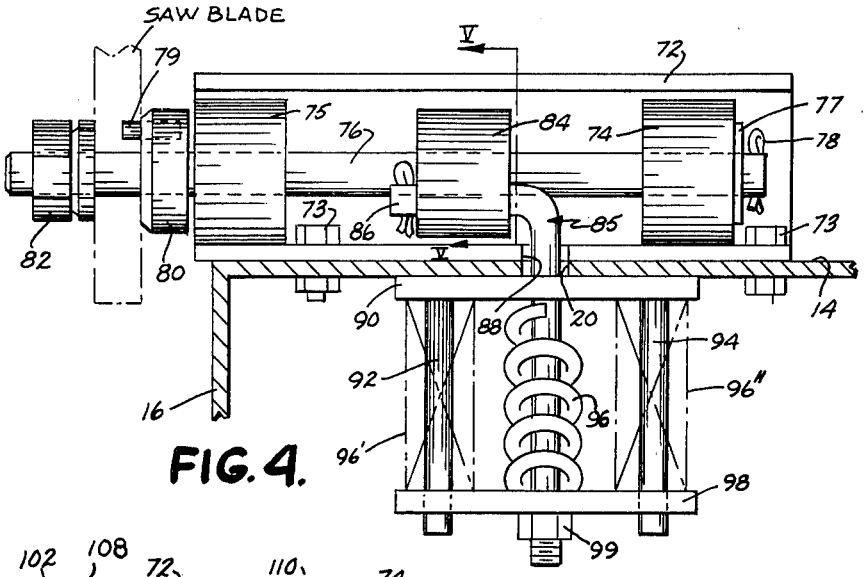
FIG. 4 is a fragmentary, rear elevation of a first embodiment of the spring-biased rotatable axle for mounting the free end of a chain saw blade for transverse cutting of work pieces.
Figure 5:
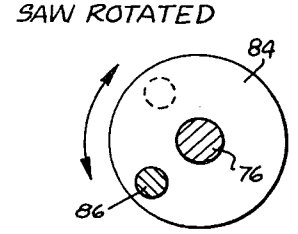
FIG. 5 is a sectional view of a portion of the rotatable axle taken along plane V—V of FIG. 4.

Referring to FIGS. 2, 4 and 5, a first embodiment 70 of the rotatable or pivotable saw support axle assembly is shown. Rotatable axle assembly 70 includes a channel-like housing 72 which opens to the rear side 17 of table 12 and is bolted to the top surface 14 of the table by a pair of bolts 75 extending through holes 21 in the top surface. The position of the assembly is chosen so that the engine of chain saw A mounted thereon will clear the lower edge of surface 14 and side 15 when pivoted downwardly. A series of holes 21 are included to accommodate various sizes of chain saws.

Welded or otherwise fixedly secured within housing 72 on the top surface of the bottom flange of the housing are a pair of spaced axle support blocks or members 74, 75 including aligned, coaxial central bores or passageways forming journal bearing surfaces for the rotatable saw support axle 76 which is fitted therethrough. Axle 76 is retained on the open end of housing 72 and the outer side of support block 74 by a washer 77 and cotter key 78 extending through the axle. The axle extends beyond the outer side of support block 75 and beyond the plane of side 16 of the support table 12 to mount the saw blade of a chain saw adjacent and parallel to side 16. The end of a chain saw blade is fitted over the end of axle 76 beyond side 16 by using a previously provided bore or aperture through the blade which is slightly larger than the size of axle 76. A second, smaller aperture is provided adjacent the main aperture in the blade for receipt of a pin 79 extending from a blade-retaining member 80 which is welded or otherwise fixedly secured to axle 76 spaced slightly from the outer side of support block 75. The blade is secured against securing member 80 by means of a flanged bolt 82 or a combination of a bolt and washer. Pin 79 extends into the saw blade at a position spaced radially from the axis of the axle 76 to prevent rotation of the blade with respect to the axle and causes the axle to rotate with blade when the chain saw is rotated downwardly as shown in FIG. 1.

In order to bias the chain saw, when fixed to axle 76, to return to a vertical position as shown in FIG. 1, a spring-biasing apparatus is provided. In embodiment 70 of the pivot assembly, the biasing force is provided by a securing block or a member 84 having a central bore therein through which is passed the axle 76. Block 84 is welded or otherwise fixedly secured to the axle (see FIG. 5). An L-shaped biasing arm 85 including a short, horizontal, upper arm 86 and a longer, generally vertical, lower arm 87 is rotatably secured to securing member 84 by passing its shorter arm 86 through a second bore in member 84 spaced radially from the central aperture. Arm 86 freely rotates in the second bore and is retained therein by a cotter key as shown in FIG. 4. The longer, vertical arm extends downwardly through slot 20 in top table surface 14 and an aligned aperture 88 in the housing 72 into a spring unit mounted below the top surface 14 so as to be concealed from view when the pivot assembly is secured to the top of the table.

The spring unit includes a rigid, spring guide pin plate or bar from which a pair of parallel guide pins or members 92, 94 extend downwardly. A coil spring 96 is telescoped over arm 87 prior to attaching a lower, rigid, spring-retaining plate 98 having a pair of apertures therethrough corresponding in location and slightly larger than guide pins 92, 94 for sliding movement thereover. Plate 98 is retained on arm 87 by a nut 99. The force of coil spring 96 urges sliding retainer plate 98 downwardly on guide pins 92, 94 along with arm 85 thereby rotating securing block or member 84 counterclockwise to its unrotated position in FIG. 5. Such movement rotates chain saw A upwardly to the position shown in FIG. 1. When logs or other work pieces are cut with the chain saw, the chain saw A is rotated downwardly pulling retaining plate 98 upwardly against the force of the coil spring 96 by means of arm 85 and retaining member 84 (see the rotated position in FIG. 5). When downward pressure on the saw is released, the saw automatically returns to its raised position.

Alternately, for heavier saws, a pair of coil springs 96' and 96'' (FIGS. 2 and 4) may be telescoped over guide pins 92, 94 in place of coil spring 96 on arm 87 to provide a stronger biasing force to return saw A to its raised position.

Figure 6:
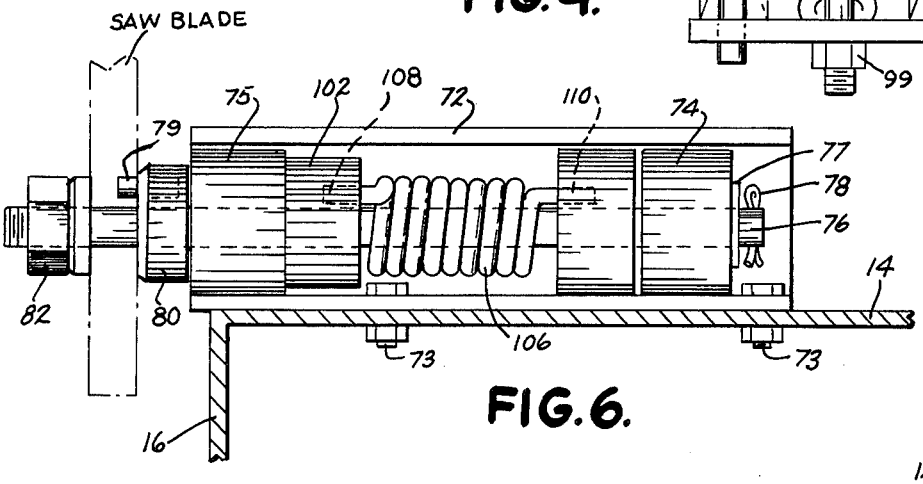
FIG. 6 is a fragmentary, rear elevation of a second embodiment of the rotatable axle.

A second embodiment 100 of the rotatable axle assembly for pivotally mounting a chain saw adjacent side 16 of the table is shown in FIG. 6. Embodiment 100 is substantially the same as embodiment 70 except for the inclusion of a different type spring unit which does not project below the table surface 14. Like numerals indicate like members in embodiments 70 and 100. Embodiment 100 includes a spring-securing member 102 fixed to axle 76 and immediately adjacent the inside surface of axle-securing member 75. Member 102 rotates with the axle as the saw blade is rotated. A second spring-securing member 104 is fixedly secured to the inside surface of the bottom of housing 72 and is, therefore, fixed with respect to table surface 14. Axle 76 passes through central bores in both members 102 and 104. The bore through member 104 forms a journal bearing surface coaxial and aligned with the journal bearing surfaces in support members 74, 75. A coil spring 106 is telescoped over axle 76. Spring 106 includes end portions 108, 110 which are parallel to the axis of the spring and axle 76, end 108 being inserted in a bore or recess in rotatable spring-securing block 102 while end 110 is inserted in a bore or recess in fixed spring securing member 104. Accordingly, rotation of the chain saw and blade on axle 76 within support members 74, 75 causes member 102 and the left-hand end 108 of spring 106 to rotate with respect to the right-hand end 110 of the spring and block 104. The biasing force of the spring to return to its original position when released returns saw A to its raised position shown in FIG. 1.

Referring now to FIGS. 7–9, a rigid saw support assembly 110 for mounting chain saw A in a stationary, generally vertical position with the plane of its blade generally parallel to the longitudinal direction of logs or other work pieces supported on table 12 and carriage 50 for longitudinal or rip cutting is shown. Saw support assembly 110 includes a pair of "L" brackets 112, 114 bolted to side 16 of the stationary support platform 12. The outwardly extending flanges or legs of brackets 112, 114 each include apertures therethrough which are aligned along a common axis generally parallel to top surface 14. A rod 116 is mounted through the apertures in brackets 112, 114 parallel to top surface 14 and spaced outwardly of side 16. One end of rod assembly 116 includes a threaded rod section 118 which is slidably fitted through the aperture in bracket 112. Threaded section 118 is threaded into or welded to a disc-like saw abutment member 122 welded or otherwise secured to the end of a rod section 120 which has a square or other noncircular cross-sectional shape. Section 120 extends through the aperture in bracket 114 along the same axis as rod section 118. Rod assembly 116 is a continuous rod having two different cross-sectional shapes at its two ends. The aperture in bracket 114 has a corresponding, square cross-sectional shape which allows the rod to slide along its axis but prevents rotation about that axis.

Saw abutment member 122 includes a projection 124 extending outwardly from one side thereof which is adapted to engage the side surface of a chain saw blade when rod section 118 is telescoped through an aperture provided in the end of that blade as shown in FIG. 9. Projection 124 extends into a second, smaller aperture spaced radially from the larger aperture in the chain saw blade to prevent rotation of the blade about rod assembly 116 and with respect to the table 12. The blade of saw A is clamped against member 122 by a flanged bolt or bolt and washer 126 as shown in FIGS. 7 and 8.

In order to accommodate and cut various sizes and diameters of logs which will be supported on platforms 12 and 13, as well as the thicknesses of the pieces cut therefrom, rod assembly 116 and saw A when attached and supported thereon may be moved parallel to the axis of the rod by loosening bolts and clamping washers 128, 130 or either side of the apertured flange of bracket 112. Accordingly, although the saw A is held in a generally vertical position such that its blade is generally perpendicular to side 16 and the plane of top surface 14, the entire saw may be moved laterally by moving the rod assembly 116 along its axis and securing the same in the desired position by tightening bolts 128, 130. Rotation of the saw from its vertical position is prevented by projection 124 on abutment member 122 and the clamping pressure of bolt 126 as well as the noncircular cross-sectional shape of rod section 120 passing through bracket 114. Logs or other work pieces may thus be urged parallel to their elongated directions against the blade of the chain saw to rip or cut the log or other work piece in a lengthwise direction.

Accordingly, the present support table and saw support apparatus provides a simple, reliable and easily used apparatus for cutting logs, boards or other work pieces either transverse to their longitudinal axis or parallel to that axis. A chain saw may be pivotally supported for cutting movement through a log or the like transverse to its axis on the pivotal axle assemblies described herein or vertically rigidly mounted for rip sawing along the longitudinal axis of the work pieces. The apparatus requires little maintenance, and change over between the two positions of the saw is simply and quickly accomplished. Movement of logs or other work pieces toward the chain saw when supported by the apparatus is greatly facilitated by movement of carriage 50 including the gripping structure 58 thereon along rails 32, 34.

While several forms of the invention have been shown and described, other forms will now be apparent to those skilled in the art. Therefore, it will be understood that the embodiment shown in the drawings and described above are merely for illustrative purposes and are not intended to limit the scope of the invention which is defined by the claims which follow.

The embodiments of the invention in which an exclusive property or privilege is claimed are defined as follows.

1. A support apparatus for supporting logs, boards and other work pieces during cutting and for supporting a chain saw for such cutting, the chain saw being of the type having an extending blade with a free end and a cutting chain extending along the peripheral edge thereof, said apparatus comprising a plurality of support legs adapted to be supported by a supporting surface and a stationary, work piece support platform mounted on said legs, said platform having a top surface inclined downwardly toward an operator position for supporting a work piece, upper, lower and side edges, and a work piece restraint mounted at the lower edge of said platform whereby gravity urges work pieces toward said restraint which holds them in a predetermined position for cutting; and pivot means on said platform located at a position spaced from said work piece restraint and said lower edge of said platform adjacent said upper edge of said platform for pivotally supporting a chain saw by the free end of its blade such that said saw may be pivoted downwardly toward said operator position into engagement with a work piece supported in said predetermined position by said platform and restraint; said pivot means adapted to support a chain saw only by the free end of its blade and including an axle for receiving a saw blade thereover, means for rotationally supporting said axle, and biasing means for urging said axle to a predetermined rotational position such that a saw, when mounted on said axle, will be returned to a raised position after being pivoted downwardly toward said operator position to cut a work piece.

2. The support apparatus of claim 1 including work piece support means extending from one side of the said first platform for supporting a portion of a work piece not supported by said platform; said work piece support means including a second platform, an elongated support for said second platform extending to said one side of said first platform, and means for mounting said second platform for movement toward and away from said first platform on said elongated support.

3. The support apparatus of claim 2 wherein said second platform includes a top surface inclined downwardly and generally parallel to said top surface of said first platform, a work piece restraint at the lower edge of said inclined top surface, and work piece gripping means on said top surface of said second platform for engaging and holding a work piece supported by said second platform.

4. A support apparatus for supporting logs, boards and other work pieces during cutting and a chain saw for such cutting comprising a plurality of support legs adapted to be supported by a supporting surface and a stationary, work piece support platform mounted on said legs, said platform having a top surface inclined downwardly toward an operator position for supporting a work piece and a work piece restraint mounted at the lower edge of said platform whereby gravity urges work pieces toward said restraint which holds them in a predetermined position for cutting; and pivot means on said platform for pivotally supporting the blade of a chain saw such that said saw may be pivoted downwardly toward said operator position into engagement with a work piece supported in said predetermined position by said platform and restraint; said pivot means adapted to support a chain saw only by its blade and including an axle for receiving a saw blade thereover, means for rotationally supporting said axle, and biasing means for urging said axle to a predetermined rotational position such that a saw, when mounted on said axle, will be returned to a raised position after being pivoted downwardly toward said operator position to cut a work piece; work piece support means extending from one side of the said first platform for supporting a portion of a work piece not supported by said platform; said work piece support means including a second platform, an elongated support for said second platform extending to said one side of said first platform, and means for mounting said second platform for movement toward and away from said first platform on said elongated support; said second platform including a top surface inclined downwardly and generally parallel to said top surface of said first platform, a work piece restraint at the lower edge of said inclined top surface, and work piece gripping means on said top surface of said second platform for engaging and holding a work piece supported by said second platform; said elongated support including a plurality of parallel rails and at least one leg for supporting said rails on a support surface; said means for mounting said second platform including a plurality of rollers supported by said rails and means for rotatably mounting said rollers on said second platform.

5. The support apparatus of claim 4 wherein said rollers each include positioning means engaging said rails for guiding movement of said rollers along said rails and preventing movement of said rollers transverse to the direction of elongation of said rails; and restraining means for retaining said second platform on said rails.

6. The support apparatus of claim 5 wherein each of said rails has the cross-sectional shape of an inverted, upwardly extending V; said rollers each including a V-shaped, circumferential recess corresponding to the shape of said V-shaped rails, said positioning means including the diverging, lateral side portions of said rollers which define said recesses; said restraining means including means extending under said rails for restraining said second platform from being lifted upwardly from said rails.

7. The support apparatus of claim 4 wherein said leg for said rails includes an adjustable shaft for raising and lowering said rails for adjusting said rails to be parallel with said top surface of said first platform such as when said apparatus is supported on an uneven surface.

8. The support apparatus of claim 1 wherein said axle extends parallel to said top surface of said platform and beyond one side edge thereof for supporting a chain saw blade adjacent the side of said platform and generally perpendicular to the plane of said top surface.

9. The support apparatus of claim 1 including a housing secured to said platform top surface; said means for rotationally supporting said axle including a pair of spaced axle support members secured within said housing, said support members including axle supporting journal bearing surfaces therein aligned with one another with said axle rotatably supported therein; said biasing means including a securing member fixed to said axle, spring means for urging said axle to said predetermined rotational position having one portion secured to said securing member for movement with said axle and another portion fixedly secured with respect to said platform; said axle including means for securing a chain saw blade in a fixed position with respect to said axle whereby rotational movement of said chain saw blade when fixed to said axle will rotate said axle against the force of said spring means.

10. A support apparatus for supporting logs, boards and other work pieces during cutting and a chain saw for such cutting comprising a plurality of support legs adapted to be supported by a supporting surface and a stationary, work piece support platform mounted on said legs, said platform having a top surface inclined downwardly toward an operator position for supporting a work piece and a work piece restraint mounted at the lower edge of said platform whereby gravity urges work pieces toward said restraint which holds them in a predetermined position for cutting; and pivot means on said platform for pivotally supporting the blade of a chain saw such that said saw may be pivoted downwardly toward said operator position into engagement with a work piece supported in said predetermined position by said platform and restraint; said pivot means adapted to support a chain saw only by its blade and including an axle for receiving a saw blade thereover, means for rotationally supporting said axle, and biasing means for urging said axle to a predetermined, rotational position such that a saw, when mounted on said axle, will be returned to a raised position after being pivoted downwardly toward said operator position to cut a work piece; a housing secured to said platform top surface; said means for rotationally supporting said axle including a pair of spaced axle support members secured within said housing, said support members including axle supporting journal bearing surfaces therein aligned with one another with said axle rotatably supported therein; said biasing means including a securing member fixed to said axle, spring means for urging said axle to said predetermined, rotational position having one portion secured to said securing member for movement with said axle and another portion fixedly secured with respect to said platform; said axle including means for securing a chain saw blade in a fixed position with respect to said axle whereby rotational movement of said chain saw blade when fixed to said axle will rotate said axle against the force of said spring means; said spring means including an L-shaped arm having one leg rotatably secured to said securing member and a second leg extending downwardly through said platform; a spring unit attached to said second leg beneath said platform top surface including a first member abutting the under side of said top surface, a pair of guide members extending downwardly from said first member, a second member secured along said second leg of said arm, slidably movable along and guided by said guide members, and at least one spring interposed between said first and second members for urging said second member away from said first member and thus said L-shaped arm downwardly and said securing member and axle and any chain saw blade thereon to said predetermined rotational position.

11. The support apparatus of claim 10 including a coil spring telescoped over said second leg of said arm between said first and second members.

12. The support apparatus of claim 10 including a pair of coil springs interposed between said first and second members, one of said springs telescoped over each of said guide members intermediate said first and second members.

13. The support apparatus of claim 9 wherein said spring means includes a second securing member fixedly secured to said housing therewithin and including an axle passageway therethrough aligned with said journal bearing surfaces, said axle extending through said axle passageway for rotation, and a coil spring telescoped over said axle and secured between said securing member and said second securing member.

14. A support apparatus for supporting logs, boards and other work pieces during cutting and a chain saw for such cutting comprising a plurality of support legs adapted to be supported by a supporting surface and a stationary, work piece support platform mounted on said legs, said platform having a top surface inclined downwardly toward an operator position for supporting a work piece and a work piece restraint mounted at the lower edge of said platform whereby gravity urges work pieces toward said restraint which holds them in a predetermined position for cutting; and pivot means on said platform for pivotally supporting the blade of a chain saw such that said saw may be pivoted downwardly toward said operator position into engagement with a work piece supported in said predetermined position by said platform and restraint; said pivot means adapted to support a chain saw only by its blade and including an axle for receiving a saw blade thereover, means for rotationally supporting said axle, and biasing means for urging said axle to a predetermined, rotational position such that a saw, when mounted on said axle, will be returned to a raised position after being pivoted downwardly toward said operator position to cut a work piece; said biasing means including a securing member secured to said axle; an L-shaped arm having one leg rotatably secured to said securing member and a second leg extending downwardly through said platform, a spring unit attached to said second leg beneath said platform top surface including a first rigid member abutting the under side of said top surface, a pair of guide members extending downwardly from said first rigid member, a second rigid member secured along said second leg of said arm, slidably movable along and guided by said guide members, and at least one spring interposed between said rigid members for urging said second rigid member away from said first rigid member and thus said L-shaped arm downwardly and said securing member and axle and any chain saw blade thereon to said predetermined rotational position.

15. The support apparatus of claim 1 wherein said biasing means include a first securing member secured to said axle, a second securing member fixedly secured with respect to said platform, and a coil spring telescoped over said axle and secured between said securing members to urge said axle to said predetermined rotational position.

16. A support apparatus for supporting logs, boards and other work pieces during cutting and for supporting a chain saw for such cutting, the chain saw being of the type having an extending blade with a free end and a chain extending along the peripheral edge thereof, said apparatus comprising a stationary work piece support platform and support legs therefor, said platform including a planar top surface having side edges and restraining means for holding work pieces in position to be cut on said top surface; rotational axle means mounted on said platform and extending beyond one side edge of said top surface for supporting a chain saw only by the end of its blade for pivotal movement about a point adjacent its free end in a plane parallel to said one side edge of said top surface to cut work pieces supported on said top surface extending beyond said one side edge; biasing means for urging said rotational axle means to a predetermined, rotational position to urge a chain saw blade to an upright, raised position when secured to said axle means; said top surface having upper and lower edges; said top surface being inclined downwardly toward an operator position at said lower edge of said platform; said restraining means positioned at said lower edge of said top surface; said rotational axle means positioned on said top surface adjacent said upper edge of said top surface whereby a chain saw, when secured to said axle means, may be rotated toward the operator position along said one side edge.

17. The support apparatus of claim 16 including a housing secured to said platform top surface; said rotational axle means including a pair of spaced axle support members secured within said housing, said support members including axle supporting journal bearing surfaces therein aligned with one another with said axle rotatably supported therein parallel to said top surface; said biasing means including a securing member fixed to said axle, spring means for urging said axle to said predetermined rotational position having one portion secured to said securing member for rotation with said axle and another portion fixedly secured with respect to said platform; said axle including means for securing a chain saw blade in a fixed position with respect to said axle whereby rotational movement of said chain saw blade when fixed to said axle will rotate said axle against the force of said spring member.

18. The support apparatus of claim 16 including work piece support means extending from the side opposite said one side of the said first platform for supporting a portion of a work piece not supported by said platform; said work piece support means including a second platform, an elongated support for said second platform extending to said opposite side of said first platform, and means for mounting said second platform for movement toward and away from said first platform on said elongated support.

19. A support apparatus for supporting logs, boards and other work pieces during cutting and a chain saw for such cutting comprising a plurality of support legs adapted to be supported by a supporting surface and a stationary, work piece support platform mounted on said legs, said platform having a top surface inclined downwardly toward an operator position for supporting a work piece and a work piece restraint mounted at the lower edge of said platform whereby gravity urges work pieces toward said restraint which holds them in a predetermined position for cutting; and pivot means on said platform for pivotally supporting the blade of a chain saw such that said saw may be pivoted downwardly toward said operator position into engagement with a work piece supported in said predetermined position by said platform and restraint; said pivot means adapted to support a chain saw only by its blade and including an axle for receiving a saw blade thereover, means for rotationally supporting said axle, and biasing means for urging said axle to a predetermined rotational position such that a saw, when mounted on said axle, will be returned to a raised position after being pivoted downwardly toward said operator position to cut a work piece; work piece support means extending from one side of the said first platform for supporting a portion of a work piece not supported by said platform; said work piece support means including a second platform, an elongated support for said second platform extending to said one side of said first platform, and means for mounting said second platform for movement toward and away from said first platform on said elongated support; said second platform including second work piece support means inclined downwardly and generally parallel to said top surface of said first platform for supporting said portion of a work piece not supported by said first platform, and a work piece restraint at the lower end of said inclined second work piece support means; said elongated support including a plurality of parallel rails and at least one leg for supporting said rails on a support surface; said means for mounting said second platform including a plurality of rollers supported by said rails and means for rotatably mounting said rollers on said second platform.

* * * * *

UNITED STATES PATENT AND TRADEMARK OFFICE

CERTIFICATE OF CORRECTION

PATENT NO. : 4,123,957

DATED : November 7, 1978

INVENTOR(S) : W. Wally Niemela et al.

It is certified that error appears in the above-identified patent and that said Letters Patent are hereby corrected as shown below:

Column 5, line 26
"75" should be -- 73 --;

Column 5, line 58
before "blade" insert -- the --;

Column 6, line 12
after "bar" insert -- 90 --;

Column 7, line 43
"or" should be -- on --;

Signed and Sealed this

*Seventeenth* Day of *July 1979*

[SEAL]

*Attest:*

*Attesting Officer*

LUTRELLE F. PARKER

*Acting Commissioner of Patents and Trademarks*